US009391396B1

(12) United States Patent
Yi et al.

(10) Patent No.: US 9,391,396 B1
(45) Date of Patent: Jul. 12, 2016

(54) LATCHING ARRANGEMENT FOR ELECTRICAL CONNECTORS

(71) Applicant: Tyco Electronics Corporation, Berwyn, PA (US)

(72) Inventors: Chong Hun Yi, Mechanicsburg, PA (US); Steven Jon McIntire, Grantville, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/739,661

(22) Filed: Jun. 15, 2015

(51) Int. Cl.

| | |
|---|---|
| ***H01R 13/629*** | (2006.01) |
| ***H01R 13/64*** | (2006.01) |
| ***H01R 13/627*** | (2006.01) |
| ***H01R 13/58*** | (2006.01) |
| ***H01R 13/646*** | (2011.01) |
| ***H01R 24/68*** | (2011.01) |
| *H01R 107/00* | (2006.01) |

(52) U.S. Cl.
CPC ..... *H01R 13/6273* (2013.01); *H01R 13/5808* (2013.01); *H01R 13/629* (2013.01); *H01R 13/646* (2013.01); *H01R 24/68* (2013.01); *H01R 2107/00* (2013.01)

(58) Field of Classification Search
CPC ..... H01R 13/629; H01R 13/6275; H01R 13/6272; H01R 13/64; H01R 23/7005; H01R 13/627
See application file for complete search history.

(56) References Cited

U.S. PATENT DOCUMENTS

| | | | | |
|---|---|---|---|---|
| 5,775,931 | A * | 7/1998 | Jones | H01R 13/631 439/358 |
| 6,865,369 | B2 * | 3/2005 | Semmeling | H01R 13/6275 434/357 |
| 6,929,500 | B2 * | 8/2005 | Noro | H01R 13/6271 439/358 |
| 7,192,297 | B1 * | 3/2007 | Wu | H01R 12/592 439/353 |
| 7,241,149 | B2 * | 7/2007 | Abadia | H01R 12/7005 439/378 |
| 7,285,005 | B2 * | 10/2007 | Gabrielsson | H01R 13/6278 439/362 |
| 7,736,172 | B2 * | 6/2010 | Yang | H01R 13/6275 439/358 |
| 2001/0004563 | A1 * | 6/2001 | Kawamae | H01R 13/6275 439/357 |
| 2004/0087202 | A1 * | 5/2004 | Baccei | H01R 13/6278 439/378 |
| 2005/0026492 | A1 * | 2/2005 | Zhang | H01R 13/6275 439/358 |
| 2005/0064758 | A1 * | 3/2005 | Li | H01R 13/65802 439/358 |
| 2005/0287860 | A1 * | 12/2005 | Yin | H01R 13/6395 439/358 |
| 2009/0035982 | A1 * | 2/2009 | Chen | H01R 13/6275 439/358 |

* cited by examiner

*Primary Examiner* — Gary Paumen

(57) ABSTRACT

An electrical connector includes a contact holder holding a plurality of contacts and a housing having a chamber holding the contact holder. The housing has a latch pocket along a first side of the housing and a guide pin positioned at or near a second side of the housing. The guide pin has a groove therein. A primary latch is received in the latch pocket and has a deflectable latching beam at a distal end thereof. The latching beam is configured for latching engagement with the mating connector for latching of the first side of the housing to the mating connector. The guide pin is configured to guide mating of the electrical connector with the mating connector. The groove is configured to receive a secondary latch of the mating connector to facilitate latching of the second side of the housing to the mating connector.

20 Claims, 4 Drawing Sheets

LATCHING ARRANGEMENT FOR ELECTRICAL CONNECTORS

BACKGROUND OF THE INVENTION

The subject matter herein relates generally to latching arrangements for electrical connectors.

Electrical connectors are provided for use in many different applications. Typically, the electrical connectors include side latches on both sides to hold both sides of the electrical connectors together. However, due to assembly error, one of the side latches may not be fully latched causing the electrical connector to rotate and possibly have electrical disconnects. When using small electrical connectors or when working in a small space, it may be difficult for an installer to visibly see that both side latches are fully engaged. Additionally, some applications are blind-mate where the installer is unable to see the electrical connectors. In such applications it may be difficult or impossible to use tools to assemble or disassemble the electrical connectors.

A need remains for a connector system that allows reliable and cost effective latching for electrical connectors.

BRIEF DESCRIPTION OF THE INVENTION

In one embodiment, an electrical connector is provided including a contact holder holding a plurality of contacts configured to be mated with corresponding contacts of a mating connector. The electrical connector includes a housing having a chamber holding the contact holder. The housing has a latch pocket along a first side of the housing. The housing has a guide pin extending forward therefrom that is positioned at or near a second side of the housing opposite the first side. The guide pin has a groove therein. A primary latch is received in the latch pocket and has a deflectable latching beam at a distal end thereof. The latching beam extends forward of the housing and is configured for latching engagement with the mating connector to facilitate latching of the first side of the housing to the mating connector. The guide pin is configured to guide mating of the electrical connector with the mating connector. The groove on the guide pin is configured to receive a secondary latch of the mating connector to facilitate latching of the second side of the housing to the mating connector.

In another embodiment, an electrical connector is provided including a contact holder holding a plurality of contacts configured to be mated with corresponding contacts of a mating connector. The contact holder has a front and a top arranged relative to the front. The contact holder has a guide pin pocket at the front configured to receive a guide pin of the mating connector. The contact holder has a latch pocket configured to receive a primary latch of the mating connector. A conductive shield is coupled to the exterior of the contact holder. The shield has a top extending along the top of the contact holder and the shield has sides extending along opposite sides of the contact holder. The shield has a primary latch extending from one of the sides of the shield into the latch pocket of the contact holder. The primary latch of the shield is configured to latchably engage the primary latch of the mating connector. The shield has a secondary latch extending from the top of the shield into the guide pin pocket. The secondary latch is configured to engage the guide pin of the mating connector. The secondary latch is configured to resist removal of the guide pin from the guide pin pocket.

DETAILED DESCRIPTION OF THE INVENTION

Figure 1:
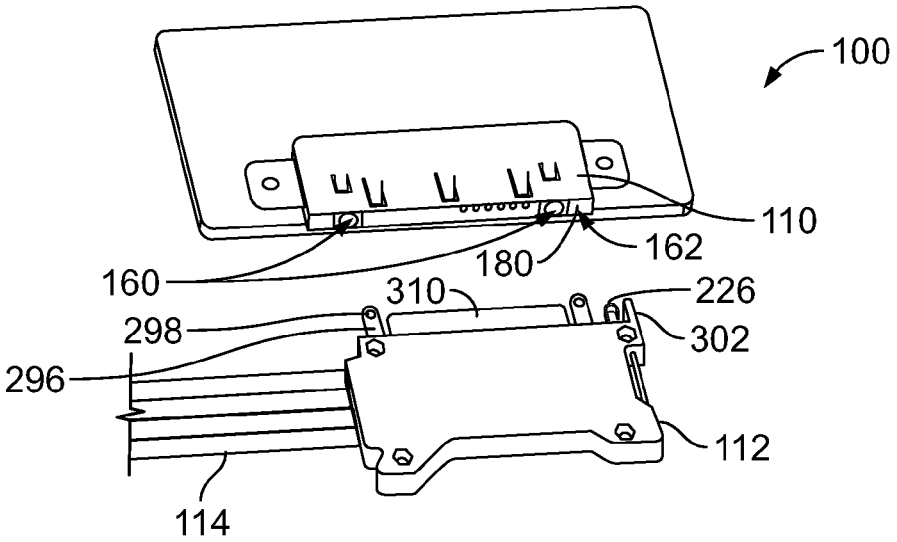
FIG. 1 shows a connector system with a cable connector thereof poised for mating with a circuit board connector of the connector system in a first orientation.

FIG. 1 illustrates a connector system 100 for an electronic device formed in accordance with an exemplary embodiment. The electronic device may be any type of electronic device. For example, the electronic device may be a display screen, such as a television display screen. In various embodiments, the electronic device may be provided in a head rest in an airline passenger seat. The electronic device may be used in other applications in alternative embodiments. Other types of electronic devices may utilize the connector system 100 in other various embodiments.

The electronic device includes a circuit board 104. The connector system 100 is electrically connector to the circuit board 104. The connector system 100 may provide data and/or power to the circuit board 104 for operating other components of the electronic device. The connector system 100 includes a first electrical connector 110 and a second electrical connector 112 mated to the first electrical connector 110. The first electrical connector 110 is mounted to the circuit board 104. The second electrical connector 112 is provided at an end of a cable bundle having one or more cables 114 that provide data and/or power to the electrical connector 112. The electrical connector 110 may be referred to hereinafter as a circuit board connector 110. The electrical connector 112 may be referred to hereinafter as a cable connector 112. When referring to the first electrical connector 110, the second electrical connector 112 may define and be referred to hereinafter as a mating connector 112. When referring to the second electrical connector 112, the first electrical connector 110 may define and be referred to herein after as a mating connector 110.

In an exemplary embodiment, the electronic device 110 may be small or may have a limited amount of working space for mating the electrical connectors 110, 112. For example, when used as a head rest monitor in a head rest of a passenger seat of an airplane, the electronic device may have a low profile and may have a limited amount of working space behind the electronic device for mating the cable connector 112 to the circuit board connector 110. In an exemplary embodiment, the electrical connectors 110, 112 have a low profile to reduce or fit in a small envelope defined by the electronic device. In an exemplary embodiment, the electrical connector 112 may be mated to the electrical connector 110 using tool-less coupling features. As such, the installer does not need to access either electrical connector 110, 112 with tools to make the electrical connection therebetween.

In an exemplary embodiment, the electrical connectors 110, 112 have blind mating features that allow the installer to mate the electrical connectors 110, 112 without visibly seeing or aligning the electrical connectors 110, 112. Optionally, the cable connector 110 may have the cables 114 extending from one of the sides thereof. The cable connector 112 thus defines a right angle connector where the cables 114 extend perpendicular from the mating face of the cable connector 112. In an exemplary embodiment, the electrical connectors 110, 112 provide electrical shielding, such as from electromagnetic interference (EMI). The cable connector 112 may provide cable strain relief for the cables 114. In an exemplary embodiment, the cable connector 112 may be oriented relative to the circuit board connector 110 such that the cables 114 are able to extend from either the left side or the right side relative to the circuit board connector 110. For example, the cable connector 112 may be oriented in a first orientation wherein the cables 114 extend from the left side thereof or may be oriented in a second orientation where the cables 114 extend from the right side thereof. The cable connector 112 may be assembled in multiple configurations to allow the left cable exit or the right cable exit depending on the particular electronic device.

Figure 2:
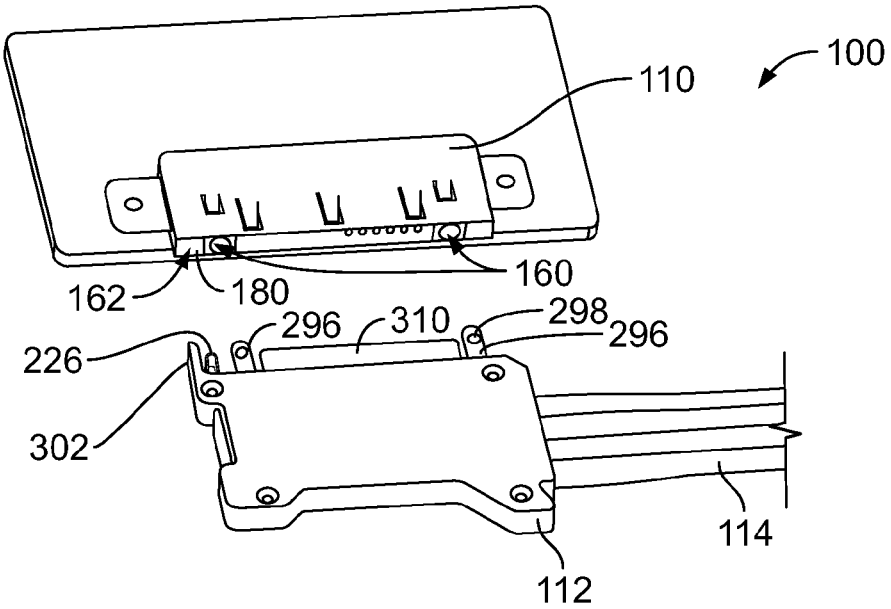
FIG. 2 shows the connector system with the cable connector poised for mating with the circuit board connector in a second orientation.

FIG. 1 shows the connector system 100 with the second electrical connector 112 poised for mating with the first electrical connector 110 in a first orientation. FIG. 2 shows the connector system 100 showing the second electrical connector 112 poised for mating with the first electrical connector 110 in a second orientation. In the first orientation (FIG. 1), the cable connector 112 is orientated such that the cables 114 exit from the left side of the cable connector 112. In the second orientation (FIG. 2), the cable connector 112 is oriented such that the cables 114 exit from the right side of the cable connector 112. The circuit board connector 110 has the same orientation in either embodiment.

Figure 3:
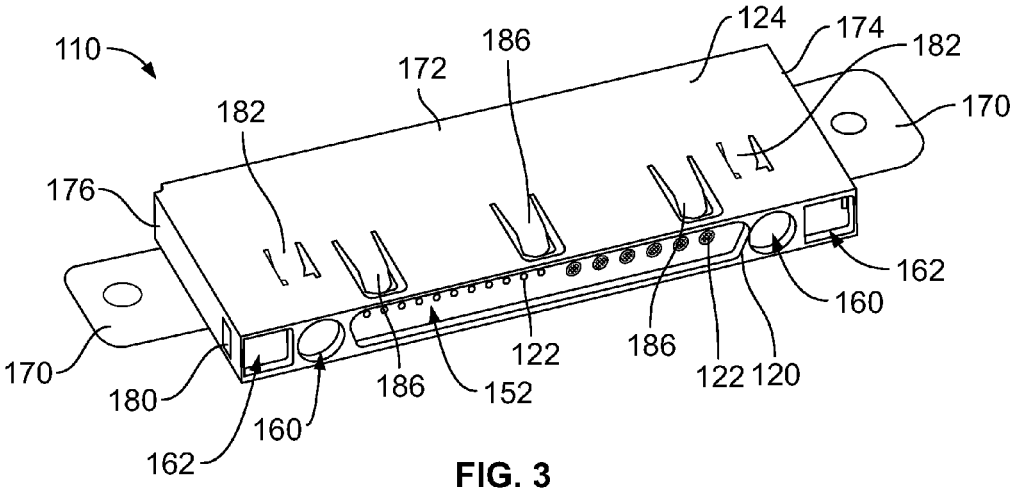
FIG. 3 is a front perspective view of the circuit board connector in accordance with an exemplary embodiment in an assembled state.
Figure 4:
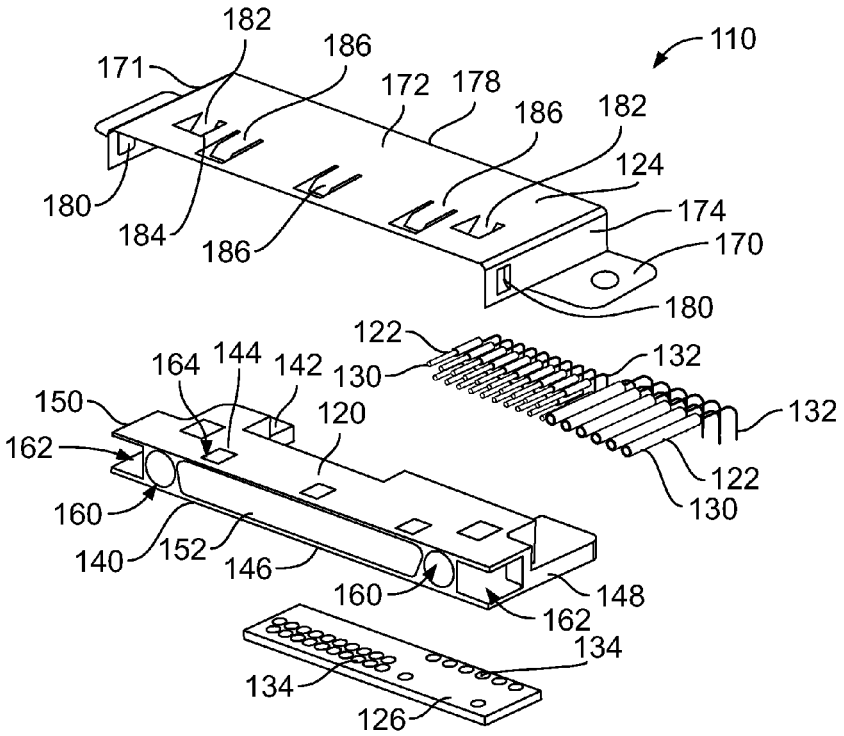
FIG. 4 is an exploded view of the circuit board connector in an exemplary embodiment.
Figure 5:
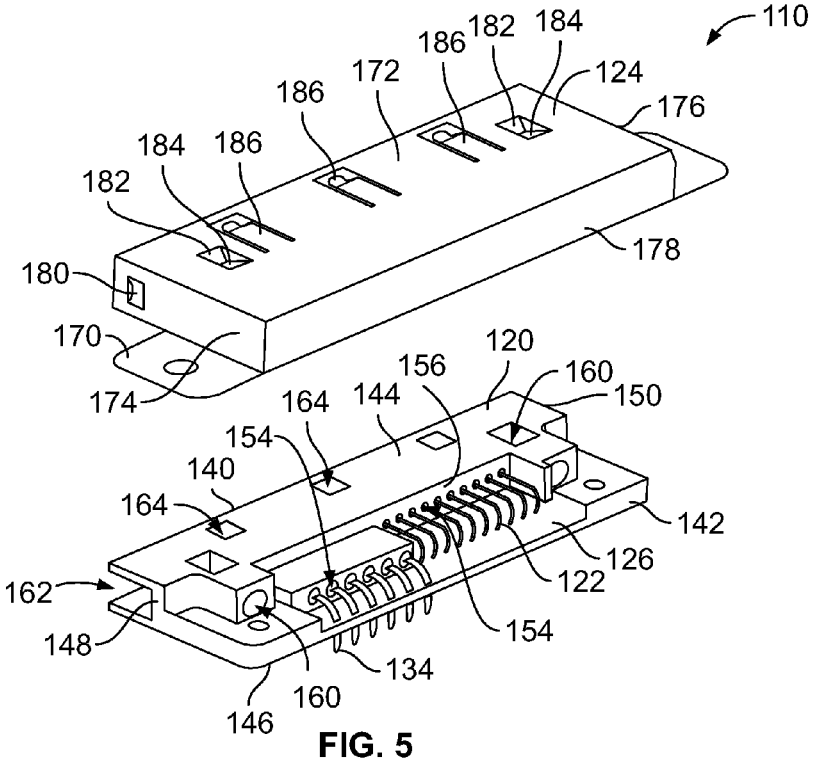
FIG. 5 is a rear exploded view of the circuit board connector in a partially assembled state.

FIG. 3 is a front perspective view of the circuit board connector 110 in accordance with an exemplary embodiment in an assembled state. FIG. 4 is an exploded view of the circuit board connector 110 in an exemplary embodiment. FIG. 5 is a rear exploded view of the circuit board connector 110 in a partially assembled state.

The electrical connector 110 includes a contact holder 120 configured to hold a plurality of contacts 122. The electrical connector 110 includes a conductive shield 124 coupled to the exterior of the contact holder 120 to provide electrical shielding for the contacts 122. The electrical connector 112 includes a pin organizer 126 used to hold the contacts 122 for mounting to the circuit board 104.

The contacts 122 extend between mating ends 130 and mounting ends 132. In an exemplary embodiment, the contacts 122 are right angle contacts wherein the mounting ends 132 are oriented perpendicular, or at right angles, to the mating ends 130. The mating ends 130 are configured to be mated with corresponding contacts of the mating connector 110 (shown in FIG. 1). The mounting ends 132 are configured to be mounted the circuit board 104. The contacts 122 may be straight contacts in alternative embodiments. Optionally, the mounting ends 132 may include circuit board pins, such as compliant pins configured to be terminated to the circuit board 104. For example, the mounting ends 132 may be received in plated vias of the circuit board 104.

Optionally, different types of contacts 122 may be provided within the contact array. For example, the cable connector 112 may include signal contacts and power contacts. In the illustrated embodiment, the signal contacts are micro-dot contacts and the power contacts are Arinc contacts; however, other types of contacts may be provided in alternative embodiments. In the illustrated embodiment, the circuit board connector 110 includes twenty signal contacts and six power contacts; however, any number of contacts may be provided in alternative embodiments.

The pin organizer 126 includes a plurality of openings 134 corresponding to the contacts 122. The pin organizer 126 is used to hold the mounting ends 132 for termination to the circuit board 104. For example, the openings 134 are arranged to hold the spacing of the mounting ends 132 for mounting to the circuit board 104. The circuit board connector 110 may be provided without the pin organizer 126 in alternative embodiments. Optionally, the pin organizer 126 may be secured to the contact holder 120, such as using adhesive, fasteners, and the like. Alternatively, the pin organizer 126 may be integral with the contact holder 120.

The contact holder 120 is used to hold the contacts 122. The contact holder 120 has a front 140 and a rear 142 opposite the front 140. The contact holder 120 extends between a top 144 and a bottom 146 opposite the top 144. The bottom 146 is configured to be mounted to the circuit board 104. The contact holder 120 includes first and second sides 148, 150 extending between the front 140 and the rear 142.

The contact holder 120 includes a contact cavity 152. The mating ends 130 of the contacts 122 are provided in the contact cavity 152 for mating with corresponding contacts of the mating connector 112 (shown in FIG. 1). The contacts 122 may extend through contact channels 154 in a rear wall 156 opposite the front 140. The contacts 122 may transition to mounting ends 132 behind the rear wall 156 and transition into the pin organizer 126. The contact cavity 152 is open and is configured to receive a portion of the cable connector 112 therein.

The contact holder 120 includes guide pin pockets 160 at the front 140 that are configured to receive guide pins of the mating connector 112. Any number of guide pin pockets 160, including a single guide pin pocket, may be provided in various embodiments. In the illustrated embodiment, the contact holder 120 includes two guide pin pockets 160 flanking either side of the contact cavity 152. Optionally, the guide pin pockets 160 may be cylindrical; however, the guide pin pockets may have other shapes in alternative embodiments. Optionally, the guide pin pockets 160 may have chamfered lead-ins at the front 140 to guide the guide pins into the guide pin pockets 160.

The contact holder includes latch pockets 162 configured to receive a primary latch of the mating connector 112. Optionally, the latch pockets 162 may be provided at the sides 148, 150. Any number of latch pockets 162 may be provided, including a single latch pocket 162. The latch pockets 162 may have any size and/or shape to receive the corresponding primary latch of the mating connector 112.

The contact holder 120 includes one or more shield openings 164 in the top 144. The shield openings 164 open to the contact cavity 152. The shield openings 164 are configured to receive portions of the conductive shield 124 such that the conductive shield 124 may be electrically connected to the mating connector 112 when the mating connector 112 is received in the contact cavity 152. In the illustrated embodiment, the shield openings 164 are rectangular in shape; however, the shield openings 164 may have other shapes in alternative embodiments. Any number of shield openings 164 may be provided in alternative embodiments.

The conductive shield 124 is configured to be coupled to the exterior of the contact holder 120. Optionally, the conductive shield 124 may be a stamped and formed shield. The conductive shield 124 includes mounting tabs 170 for securing the conductive shield 124 to the circuit board 104. The conductive shield 124 includes a top 172 and opposite sides 174, 176 extending from the top 172. The conductive shield includes a rear 178 extending between the sides 174, 176. The top 172, sides 174, 176 and rear 178 form a shielded chamber around the contact holder 120. In the illustrated embodiment, the bottom and the front of the conductive shield 124 are open; however, the conductive shield 124 may include walls along the front and/or the bottom in alternative embodiments.

The conductive shield 124 includes a primary latch 180 along the side 174 and/or 176. In the illustrated embodiment, the conductive shield 124 includes primary latches 180 along both sides 174, 176. The primary latch 180 is used to latchably secure the cable connector 112 to the circuit board connector 110. Optionally, the primary latch 180 may be stamped and formed from the side 174 and/or 176. The primary latch 180 is positioned interior of the side 174 and/or 176. When the conductive shield 124 is coupled to the contact holder 120, the primary latch 180 extends into the corresponding latch pocket 162. The primary latch 180 is configured to be engaged by a corresponding primary latch of the cable connector 112.

The conductive shield 124 includes one or more secondary latches 182 that are used as a secondary latching feature for securing the cable connector 112 to the circuit board connector 110. The secondary latches 182 are configured to extend into corresponding guide pin pockets 160 and are configured to latchably secure to corresponding guide pins that are received in the guide pin pockets 160. In an exemplary embodiment, the secondary latches 182 are integrally formed with the conductive shield 124. For example, the secondary latches 182 may be stamped and formed from the top 172 of the conductive shield 124. The secondary latches 182 extend downward from the top 172 into the shielded chamber of the conductive shield 124. The secondary latches 182 extend through the top 144 of the contact holder 120 and are loaded into corresponding guide pin pockets 160. Each secondary latch 182 includes a tip 184 configured to engage the corresponding guide pin. In the illustrated embodiment, the secondary latch 182 is V-shaped and the tip 184 is provided at the bottom thereof. The tip 184 is positioned in the guide pin pocket 160 to latchably engage the corresponding guide pin when the guide pin is loaded into the guide pin pocket 160.

The conductive shield 124 includes spring beams 186 extending from the tops 172. Any number of spring beams 186 may be provided. The spring beams 186 are received in corresponding shield openings 164 in the contact holder 120 and are configured to engage the mating connector 112. The spring beams 186 are configured to be electrically connected to a shield or other conductive structure of the mating connector 112 when the mating connector 112 is mated with the circuit board connector 110. In an exemplary embodiment, the spring beams 186 are deflectable and are configured to be spring biased against the mating connector 112. In an exemplary embodiment, the spring beams 186 are integrally formed with the conductive shield 124. For example, the spring beams 186 may be stamped and formed from the top 172.

Figure 6:
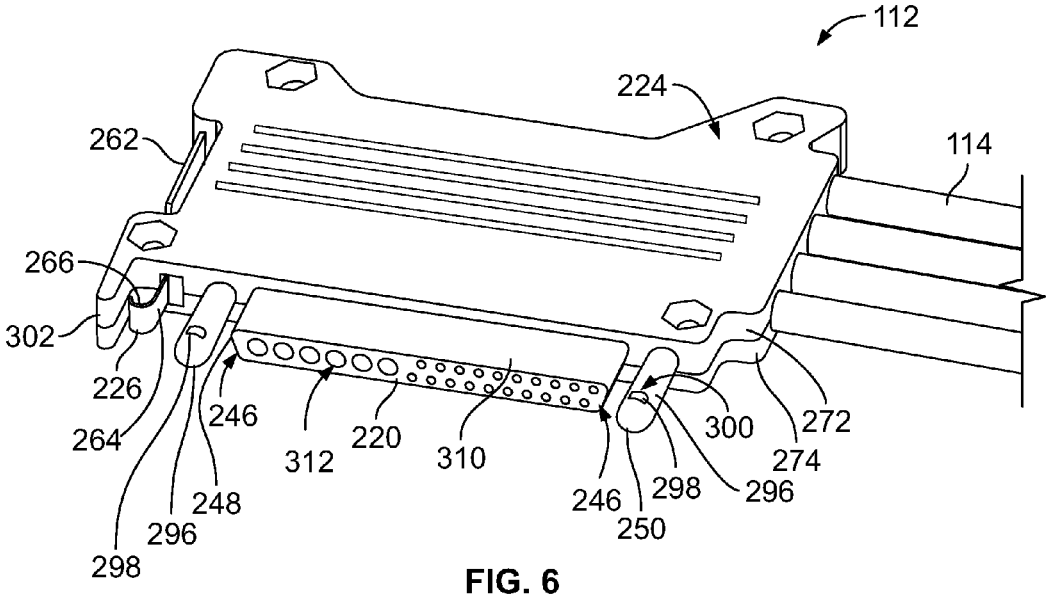
FIG. 6 is a front perspective view of the cable connector formed in accordance with an exemplary embodiment.
Figure 7:
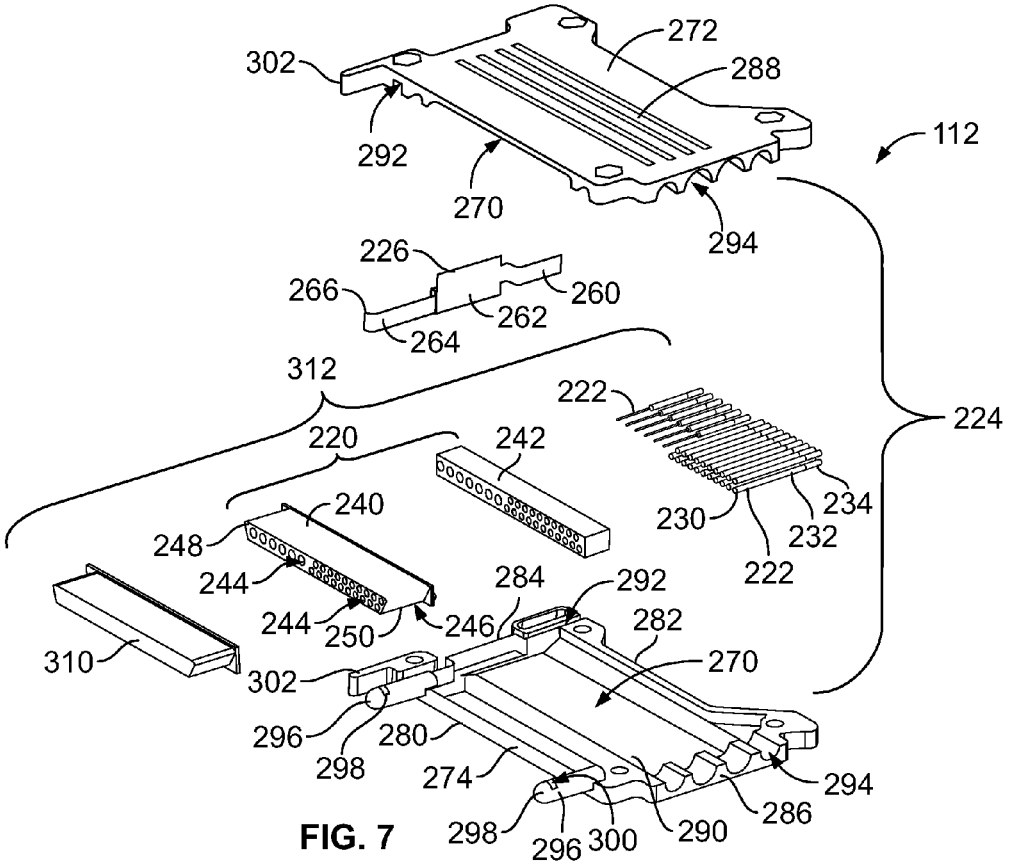
FIG. 7 is an exploded view of the cable connector.
Figure 8:
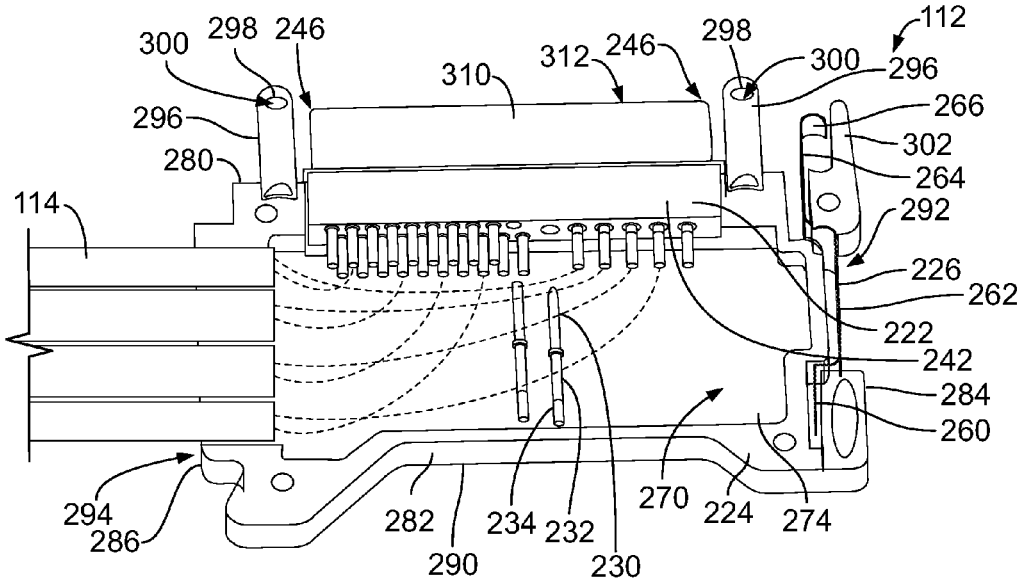
FIG. 8 is a partially assembled view of a portion of the cable connector.

FIG. 6 is a front perspective view of the cable connector 112 formed in accordance with an exemplary embodiment. FIG. 7 is an exploded view of the cable connector 112. FIG. 8 is a partially assembled view of a portion of the cable connector 112.

The cable connector 112 includes a contact holder 220 configured to hold a plurality of contacts 222. The contacts 222 are configured to be mated with corresponding contacts 122 of the circuit board connector 110. The cable connector 112 includes a housing 224 configured to hold the contact holder 220 and the contacts 222. In an exemplary embodiment, the housing 224 is conductive and provides electrical shielding for the contacts 222. The cable connector 112 includes a primary latch 226 held by the housing 224. The primary latch 226 is used for securing the cable connector 112 to the circuit board connector 110. For example, the primary latch 226 may latchably engage the primary latch 180 (shown in FIG. 4) of the circuit board connector 110.

The contacts 222 extend between mating ends 230 and terminating ends 232 opposite the mating ends 230. In an exemplary embodiment, the contacts 222 are crimp contacts configured to be crimped to ends of wires 234 of the cables 114. The contacts 222 may be terminated to the wires 234 by other processes in alternative embodiments. The contacts 222 may include pins or sockets at the mating ends 230 for mating with corresponding contacts 122. In an exemplary embodiment, the cable connector 112 includes both signal contacts and power contacts.

The contact holder 220 may include a front contact holder 240 and a rear contact holder 242, which may be coupled to the front contact holder 240. For example, the rear contact holder 242 may be coupled to the front contact holder 240 using adhesive, fasteners or by other processes. The front contact holder 240 holds the contacts 222. The rear contact holder 242 may hold the contacts 222 and/or the wires 234. In an exemplary embodiment, the front contact holder 240 includes a plurality of contact channels 244 that receive corresponding contacts 222. The front contact holder 240 includes latches (not shown) in the contact channels 244 to secure the contacts 222 within the contact channels 244. The contacts 222 may be removed from the contact channels 244 by releasing the latches.

In an exemplary embodiment, the contact holder 222 may include polarizing features 246 for polarized mating with the mating connector 110. For example, in the illustrated embodiment, the front contact holder 240 includes angled sides 248, 250 such that the front contact holder 240 has a generally trapezoidal shape. The front contact holder 240 may have other shapes in alternative embodiments. The polarizing features 246 insure that the cable connector 112 is mated in a particular orientation relative to the mating connector 110. Optionally, the front contact holder 240 may be held in the housing 224 in different orientations (e.g. right side up vs. upside down) to change the orientation of the polarizing features, and thus change the mating orientation of the cable connector 112 with respect to the circuit board connector 110. As such, the cable exit orientation may change.

The primary latch 226 includes a base 260, an actuator 262 forward of the base 260 and a latching beam 264 forward of the actuator 262. Optionally, the base 260 may be fixed in the housing 224 with the actuator 262 exposed exterior of the housing 224 for actuation and releasing of the primary latch 226. When the actuator 262 is pressed, the latching beam 264 may be moved from a latched position to an unlatched position. The latching beam 264 has a hook 266 at the distal end of the latching beam 264. In the illustrated embodiment, the hook 266 is turned outward. The hook 266 is configured to latchably engage the primary latch 180 (shown in FIG. 4) of the circuit board connector 110 to latchably secure the cable connector 112 to the circuit board connector 110.

The housing 224 includes a chamber 270 that receives the contact holder 220 and the contacts 222. In an exemplary embodiment, the housing 224 is a two part housing including a first shell 272 and a second shell 274. The first and second shells 272, 274 form the chamber 270. The first and second shells 272, 274 may form a clam shell arrangement. The first shell 272 may be secured to the second shell 274 using fasteners (not shown). Optionally, the first shell 272 may be hingeably coupled to the second shell 274.

The housing 224 includes a front 280, a rear 282 and opposite sides 284, 286 extending between the front 280 and the rear 282. In an exemplary embodiment, the first shell 272 defines a first end 288 of the housing 224 and the second shell 274 defines a second end 290 of the housing 224. Optionally, the first end 288 may define a top of the housing 224 while the second end 290 defines a bottom of the housing 224. In other embodiments, the housing 224 may be oriented such that the second end 290 defines a top of the housing 224 while the first end 288 defines a bottom of the housing 224. For example, by changing an orientation of the contact holder 222 in the chamber 270, one or the other end 288, 290 may define the top while the other end 288, 290 defines the bottom.

In an exemplary embodiment, the housing 224 includes a latch pocket 292 along the first side 284. The latch pocket 292 is configured to receive the primary latch 226. The base 260 may be fixed in the latch pocket 292, while the actuator 262 and latching beam 264 may move within the latch pocket 292. In an exemplary embodiment, the housing 224 includes a plurality of cable exits 294 at the second side 286. The cables 114 may pass through corresponding cable exits 294. The cables 114 extend into the chamber 270 through the cable exits 294. Optionally, if fewer cables 114 are utilized than cable exits 294 provided, plugs may be received in the cable exits 294 to reduce EMI leakage through the unused cable exits 294.

The housing 224 includes one or more guide pins 296 extending from the front 280. Optionally, the guide pins 296 may be integral with the housing 224. In the illustrated embodiment, two guide pins 296 are provided flanking either side of the chamber 270. In an alternative embodiment, a single guide pin 296 is provided at or near the second side 286 opposite the primary latch 226. Such guide pins 296 holds the second side 286 while the primary latch 226 holds the first side 284. The guide pins 296 are used to guide mating of the cable connector 112 with the circuit board connector 110. The guide pins 296 are configured to be received in corresponding guide pin pockets 160 (shown in FIG. 2). In the illustrated embodiment, the guide pins 296 are cylindrical; however, the guide pins 296 may have other shapes in alternative embodiments. Optionally, distal ends of the guide pins 296 may be tapered to provide lead-in when mating the guide pins 296 to the mating connector 110.

In an exemplary embodiment, the guide pins 296 include grooves 298 in the exterior surfaces thereof. The grooves 298 may extend circumferentially around the guide pins 296 or may be formed only along the top of the guide pins 296. The grooves 298 define secondary latches 300 of the cable connector 112. The secondary latches 300 are configured to engage corresponding secondary latches 182 (shown in FIG. 2) of the circuit board connector 110 to provide secondary securing for the cable connector 112 to the mating connector 110. For example, the primary latch 226 may be used to secure the first side 284 to the mating connector 110 while the secondary latch 300 may be used to secure the second side 286 to the mating connector 110.

The housing 224 includes a latch shield 302 near the latch pocket 292. The latch shield 302 extends forward from the front 280. The latch shield 302 is provided outside of the primary latch 226 and provides shielding for the primary latch 226 to prevent damage to the primary latch 226. The latch shield 302 may be used to align the cable connector 112 with the circuit board connector 110.

In an exemplary embodiment, the cable connector 112 includes a contact shell 310 provided at the front of the cable connector 112. The contact shell 310 may form a part of the housing 224. In an exemplary embodiment, the contact shell 310 is conductive and provides electrical shielding for the mating ends 230 of the contacts 222. The front contact holder 240 may be received in the contact shell 310. The contact shell 310 may have a complementary shape as the front contact holder 240. For example, the contact shell 310 may have angled sides that define polarizing features of the cable connector 112 for polarized mating with the circuit board connector 110.

Optionally, the contact shell 310 may be a separate piece from the first and second shells 272, 274 to allow the contact shell 310 to have different orientations with respect to the shells 272, 274 when coupled thereto. For example, the contact shell 310, the contact holder 220 and the contacts 222 may form a contact sub-assembly that may be assembled and loaded into the housing 224. For example, the contacts 222 may be loaded into the contact holder 220 and the contact shell 310 may be coupled to the front contact holder 240 to form the contact sub-assembly 312. The contact sub-assembly 312 may then be loaded into the second shell 274 with the cables 114 extending through the cable exits 294. The contact sub-assembly 312 may be loaded into the second shell 274 in a right-side up orientation or an upside-down orientation to change the orientation of the polarizing features relative to the housing 224. In other words, the wider end of the contact shell 310 and front contact holder 240 may be upward facing when loaded into the second shell 274 or may be downward facing when loaded into the second shell 274. As such, when the cable connector 112 is mated to the circuit board connector 110, the cable connector 112 may have the cables exiting to the right or to the left relative to the circuit board connector 110 depending on the orientation of the cable connector 112 with respect to the circuit board connector 110.

Returning to FIGS. 1 and 2, during mating the cable connector 112 is aligned with the circuit board connector 110 in either a left cable exit orientation (FIG. 1) or a right cable exit orientation (FIG. 2). In the left cable exit orientation, the primary latch 226 is on the right side of the cable connector 112 and aligned with the corresponding latch pocket 162 of the circuit board connector 110. In the right cable exit orientation, the primary latch 226 is on the left side of the cable connector 112 and aligned with the corresponding latch pocket 162 of the circuit board connector 110. The primary latch 226 is configured to engage the primary latch 180 of the circuit board connector 110 when mated thereto. In an exemplary embodiment, the primary latch 226 may make an audible click sound when properly latched to the primary latch 180.

The guide pins 296 are aligned with the guide pin pockets 160 during mating. In an exemplary embodiment, the guide pins 296 extend further forward than the contact shell 310, the primary latch 226 or the latch shield 302. The guide pins 296 are the first portions of the cable connector 112 to mate with the circuit board connector 110. The guide pins 296 may be used for blind mating of the cable connector 112 by aligning the cable connector 112 with the circuit board connector 110 for mating the contacts 222, 122.

When mated, the grooves 298 of the guide pins 296 are received in the guide pin pockets 160 and aligned with the secondary latches 182. The secondary latches 182 are received in the grooves 298 to provide a securing or holding force of the guide pins 296 in the circuit board connector 110. The secondary latches 182 are spring biased into the grooves 298 to provide the holding force. As such, a latching arrangement is provided for the electrical connectors 110, 112 whereby the primary latch 226 provides the primary retaining or securing force for the first side 284 of the cable connector 110, the secondary latches 182 provide retaining or securing force for the second side 286 of the cable connector 110. Only one actuatable latch is used for latching, while secondary latching is provided with the secondary latches that are engaged and disengaged by pushing or pulling the cable connector 112 in a mating or unmating direction. The secondary latches provide a simpler latching arrangement then providing two actuatable latches. Additionally, the latching arrangement may be accomplished without the need for additional tools.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a contact holder holding a plurality of contacts configured to be mated with corresponding contacts of a mating connector;

a housing having a chamber holding the contact holder, the housing having a latch pocket along a first side of the housing, the housing having a guide pin extending forward therefrom, the guide pin being positioned at or near a second side of the housing opposite the first side, the guide pin having a groove therein; and a primary latch received in the latch pocket, the primary latch having a deflectable latching beam at a distal end thereof, the latching beam extending forward of the housing and configured for latching engagement with the mating connector to facilitate latching of the first side of the housing to the mating connector;

wherein the guide pin is configured to guide mating of the electrical connector with the mating connector, the groove on the guide pin being configured to receive a secondary latch of the mating connector to facilitate latching of the second side of the housing to the mating connector.

2. The electrical connector of claim 1, wherein the guide pin is cylindrical and is configured to engage the mating connector prior to the primary latch engaging the mating connect.

3. The electrical connector of claim 1, wherein the guide pin is integral with the housing.

4. The electrical connector of claim 1, further comprising a second guide pin having a groove configured to receive a corresponding secondary latch of the mating connector, the second guide pin positioned between the contacts and the primary latch.

5. The electrical connector of claim 1, wherein the housing includes a plurality of cable exits at the second side, the second side being perpendicular to a front of the housing, the guide pin extending from the front.

6. The electrical connector of claim 1, wherein the housing includes a contact shell at a front of the housing, the contact shell providing electrical shielding for the contacts at interfaces of the contacts with the contacts of the mating connector, the guide pin being positioned between the contact shell and the second side, the primary latch being positioned between the contact shell and the first side.

7. The electrical connector of claim 1, wherein the primary latch comprises an actuator, the primary latch being exposed at the first side, the actuator being pressed to deflect the latching beam.

8. The electrical connector of claim 1, wherein the contacts are crimp contacts configured to be crimped to ends of corresponding wires, the wires extending from the chamber of the housing through the second side.

9. The electrical connector of claim 1, wherein the housing comprises a first shell and a second shell forming the chamber, the contact holder being positioned in the chamber between the first and second shells, the housing comprising a contact shell extending forward from the chamber from a front of the housing, the contact shell receiving a portion of the contact holder and portions of the contacts.

10. The electrical connector of claim 9, wherein the contact shell, contact housing and contacts form a contact sub-assembly, the contact sub-assembly having a polarizing feature for polarized mating with the mating connector, the contact sub-assembly being received in the housing in a first orientation and an opposite second orientation to change a mating orientation of the electrical connector with respect to the mating connector.

11. An electrical connector comprising:

a contact holder holding a plurality of contacts configured to be mated with corresponding contacts of a mating connector, the contact holder having a front and a top arranged relative to the front, the contact holder having a guide pin pocket at the front configured to receive a guide pin of the mating connector, the contact holder having a latch pocket configured to receive a primary latch of the mating connector; and a conductive shield coupled to the exterior of the contact holder, the shield having a top extending along the top of the contact holder and the shield having sides extending along opposite sides of the contact holder, the shield having a primary latch extending from one of the sides of the shield into the latch pocket of the contact holder, the primary latch of the shield being configured to latchably engage the primary latch of the mating connector, the shield having a secondary latch extending from the top of the shield into the guide pin pocket, the secondary latch being configured to engage the guide pin of the mating connector, the secondary latch being configured to resist removal of the guide pin from the guide pin pocket.

12. The electrical connector of claim 11, wherein the conductive shield is stamped and formed with the primary latch and the secondary latch being stamped from a common blank.

13. The electrical connector of claim 11, wherein the conductive shield includes a second primary latch extending from the opposite side of the conductive shield, the second primary latch being received in a second latch pocket of the contact holder.

14. The electrical connector of claim 11, wherein the contact holder includes a plurality of guide pin pockets configured to receive corresponding guide pins of the mating connector, the conductive shield including a plurality of secondary latches extending into corresponding guide pin pockets to engage the corresponding guide pins.

15. The electrical connector of claim 11, wherein the secondary latch includes a tip configured to be received in a groove of the guide pin to latchably secure the secondary latch to the guide pin.

16. The electrical connector of claim 11, wherein the secondary latch is V-shaped and extends inward into the guide pin pocket.

17. The electrical connector of claim 11, wherein the guide pin pocket is positioned between the contacts and the corresponding side of the contact holder.

18. The electrical connector of claim 11, wherein the contacts are right angle contacts having mating ends positioned in a contact cavity of the contact holder and mounting ends opposite the mating ends and configured to be terminated to a circuit board.

19. The electrical connector of claim 11, further comprising a pin organizer having a plurality of openings therethrough, the pin organizer holding circuit board pins of the contacts for termination to a circuit board.

20. The electrical connector of claim 11, wherein the conductive shield includes spring beams extending at least partially through shield openings in the contact holder to engage the mating connector and electrically connect the conductive shield to the mating connector.

* * * * *